US009450362B2

(12) United States Patent
Wang

(10) Patent No.: US 9,450,362 B2
(45) Date of Patent: Sep. 20, 2016

(54) CONNECTOR STRUCTURE

(71) Applicant: Getac Technology Corporation, Hsinchu County (TW)

(72) Inventor: Chen-Ping Wang, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 0 days.

(21) Appl. No.: 14/590,523

(22) Filed: Jan. 6, 2015

(65) Prior Publication Data

US 2015/0288091 A1 Oct. 8, 2015

(30) Foreign Application Priority Data

Apr. 8, 2014 (CN) ..... 2014 1 0136863

(51) Int. Cl.
*H01R 12/82* (2011.01)
*H01R 31/06* (2006.01)
*H01R 12/71* (2011.01)

(52) U.S. Cl.
CPC ..... *H01R 31/06* (2013.01); *H01R 12/714* (2013.01)

(58) Field of Classification Search
CPC ..... H01R 13/5202
USPC ..... 439/259, 587, 88, 118; 200/50.09; 361/679.41, 679.42
See application file for complete search history.

(56) References Cited

U.S. PATENT DOCUMENTS 5,562,467 A * 10/1996 Davis, II ..... H01R 13/24 200/51.09
5,980,288 A * 11/1999 Jarvis ..... F21V 23/06 439/188
2002/0004329 A1* 1/2002 Ikeya ..... H01R 13/193 439/259
2002/0074640 A1 6/2002 Gamboa
2002/0197895 A1* 12/2002 Eldridge ..... G01R 1/0735 439/259
2003/0003789 A1* 1/2003 Sato ..... H01R 13/2414 439/259
2003/0096523 A1* 5/2003 Tateishi ..... H05K 7/1023 439/259

(Continued)

FOREIGN PATENT DOCUMENTS

TW I335692 1/2011

*Primary Examiner* — Abdullah Riyami
*Assistant Examiner* — Nelson R Burgos-Guntin
(74) *Attorney, Agent, or Firm* — Locke Lord LLP; Tim Tingkang Xia, Esq.

(57) ABSTRACT

A connector structure, being capable of connecting with an external connector, includes a chassis, a first electronic assembly, a flexible connecting piece and a second electronic assembly. The chassis has an opening. The first electronic assembly includes a first pin-set. The flexible connecting piece is located on the surrounding of the first pin-set, and the first electronic assembly is connected with the chassis by the flexible connecting piece, so that first pins are exposed from the opening. The second electronic assembly is located inside the chassis and includes a second pin-set, wherein the second pin-set is located below the first pin-set and keeps a distance from the first pin-set. The external connector is electrically connected with the first pin-set for deforming the flexible connecting piece, such that the first pin-set moves downward and is electrically connected with the second pin-set.

5 Claims, 4 Drawing Sheets

(56) References Cited

U.S. PATENT DOCUMENTS

2003/0232533 A1* 12/2003 Burmeister ..... H01R 12/721 439/259
2008/0290883 A1* 11/2008 Yuan-Chi ..... G01R 1/0408 324/756.05
2009/0035975 A1* 2/2009 Arai ..... H01R 13/111 439/259
2010/0105229 A1* 4/2010 Ohsako ..... H01R 13/113 439/259
2010/0227490 A1* 9/2010 Lin ..... G01R 1/0466 439/259
2011/0267745 A1* 11/2011 Cheng ..... G02B 6/0046 361/679.01
2015/0017831 A1* 1/2015 Wang ..... H01R 13/6683 439/488
2015/0288091 A1* 10/2015 Wang ..... H01R 31/06 439/587

* cited by examiner

CONNECTOR STRUCTURE

CROSS-REFERENCE TO RELATED APPLICATIONS

This non-provisional application claims priority under 35 U.S.C. §119(a) on Patent Application No(s). 201410136863.1 filed in China on Apr. 8, 2014, the entire contents of which are hereby incorporated by reference.

BACKGROUND OF THE INVENTION

1. Field of the Invention

The invention relates to a connector structure, and particularly relates to a connector structure having a flexible connecting piece.

2. Description of Related Art

With the rapidly progressing development of technology, portable devices such as a notebook computer and a tablet computer have been broadly adopted in daily lives. In general, the portable devices require exposed connectors as a medium for electrical connection to other electronic devices. Therefore, even when not in use, the connector is still electrified. Thus, when a user is situated in a damp environment and uses the portable device for a period of time, not only the issue of short circuit arises, but elelctrolytic phenomenon also easily happens at terminals of the connector.

SUMMARY OF THE INVENTION

A connector structure is provided, which is switchable via a floating structure.

A connector structure is provided, adapted for connecting with an external connector. The connector structure includes a chassis, a first electronic assembly, a flexible connecting piece and a second electronic assembly. The chassis has an opening. The first electronic assembly includes a first pin-set. The flexible connecting piece is located on the surrounding of the first pin-set, and the first electronic assembly is connected with the chassis by the flexible connecting piece, so that first pins are exposed from the opening. The second electronic assembly is located inside the chassis and includes a second pin-set, wherein the second pin-set is located below the first pin-set and keeps a distance from the first pin-set. The external connector is electrically connected with the first pin-set for deforming the flexible connecting piece, such that the first pin-set moves downward and is electrically connected with the second pin-set.

Based on the above, since the first electronic assembly is connected to the chassis via the flexible connecting piece and keeps a distance from the second pin-set of the second electronic assembly, the first electronic assembly and the second electronic assembly remain a broken circuit when the external connector has not been connected with the first electronic assembly. Furthermore, when the external connector is connected with and presses the first pin-set of the first electronic assembly, not only the flexible connecting piece is forced and deformed, but the first pin-set is also able to move downward to be electrically connected with the second pin-set of the second electronic assembly to realize the state of electrical conductance.

Accordingly, the connector structure provides the first electronic assembly as the floating switch between the external connector and the second electronic assembly via the flexible connecting piece, so as to achieve the effect of electrical connection or broken circuit. Thus, when not in use, the connector structure is exposed from the chassis with the non-electrified first electronic assembly, and thereby the condition of short circuit or electrolysis does not happen even if exposed to a damp environment.

In order to make the aforementioned and other features and advantages of the present invention more comprehensible, several embodiments accompanied with figures are described in detail below.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DESCRIPTION OF EMBODIMENTS

Figure 1:
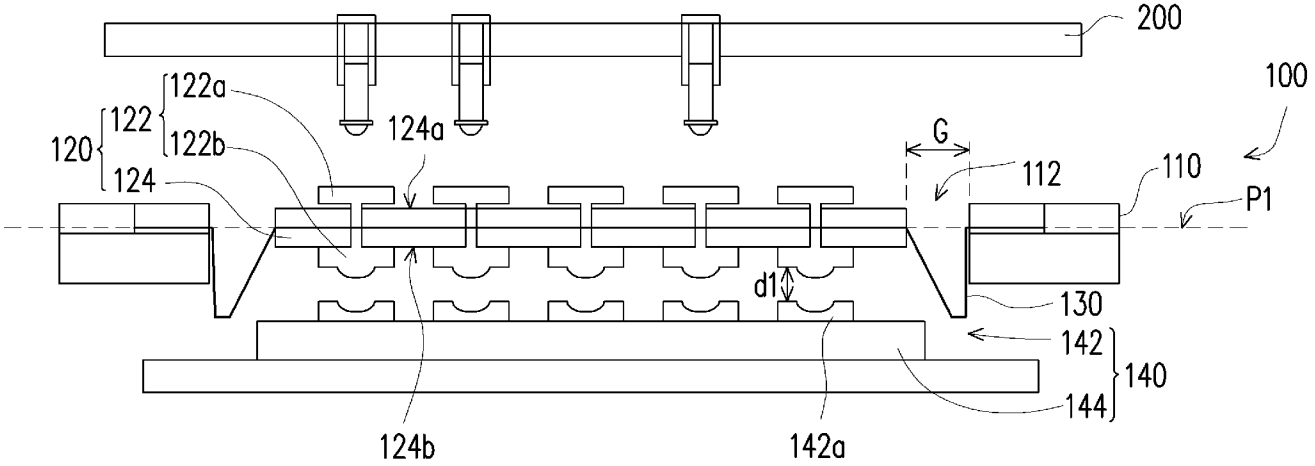
FIG. 1 is a sectional view of a connector structure according to an embodiment of the invention.

FIG. 1 is a sectional view of a connector structure according to an embodiment of the invention. Referring to FIG. 1, in the embodiment, a connector structure 100 includes a chassis 110, a first electronic assembly 120, a flexible connecting piece 130 and a second electronic assembly 140. The connector structure 100 is adapted for being disposed in a variety of electronic devices (not shown), so as to be electrically connected to an external connector 200 of other electronic devices to achieve the function of power transmission or data transmission.

In the embodiment, the chassis 110 has an opening 112. The first electronic assembly 120 includes a first pin-set 122 and a first substrate 124. The first substrate 124 has a top surface 124*a* and a bottom surface 124*b* opposite to each other, and the size of the opening 112 is greater than the size of the first substrate 124.

The first pin-set 122 includes a plurality of first pins 122*a* and a plurality of second pins 122*b*, wherein the first pins 122*a* and the second pins 122*b* are disposed respectively on two surfaces opposite to each other of the first substrate 124. More specifically, the first pins 122*a* are disposed on the top surface 124*a* of the first substrate 124, and the second pins 122*b* are disposed on the bottom surface 124*b* of the first substrate 124. In addition, the first pins 122*a* and the second pins 122*b* respectively penetrate the top surface 124*a* and the bottom surface 124*b* of the first substrate 124, so that the first pins 122*a* correspond respectively to a plurality of second pins 122*b* and are electrically connected to the plurality of second pins 122*b*.

Figure 2:
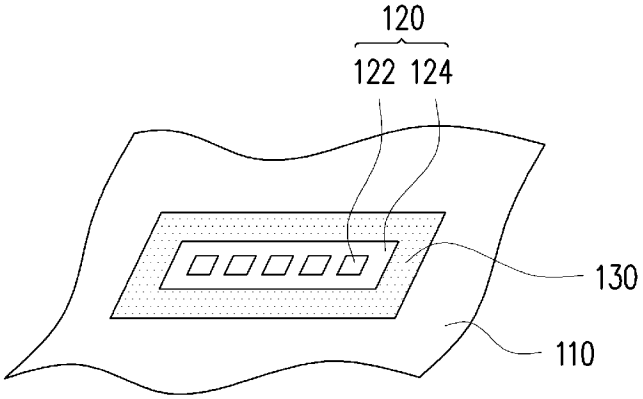
FIG. 2 is a schematic diagram of a partial perspective view of the connector structure.

FIG. 2 is a schematic diagram of a partial perspective view of the connector structure. Referring to both FIGS. 1 and 2, the flexible connecting piece 130 of the embodiment is located on the surrounding the first pin-set 122 on the first substrate 124 and is connected between the first substrate 124 and the chassis 110, so as to seal a gap G (shown in FIG. 1) between the chassis 110 and the first substrate 124 at the opening 112. Thereby, the first substrate 124 floats at the opening 112 via the flexible connecting piece 130, so that the first pin-set 122 is exposed at the opening 112. In the embodiment, the flexible connecting piece 130 is, for example, rubber or other materials having both flexibility and elasticity, but the invention is not limited thereto. The flexible connecting piece 130 may further be formed of waterproof materials and connected to the chassis 110 and the first electronic assembly 120 in a water resistant manner, so as to prevent outside liquids from permeating into the chassis 110 to achieve the effect of water resistance.

Referring again to FIG. 1, the second electronic assembly 140 is disposed within the chassis 110, and the second electronic assembly 140 includes a second pin-set 142 and a second substrate 144. The second pin-set 142 is located beneath the first pin-set 122, and the second substrate 144 is disposed within the chassis 110. The second pin-set 142 has a plurality of third pins 142*a*, and the third pins 142*a* are disposed on the second substrate 144.

In addition, as shown in FIG. 1, the first pins 122*a* in the first pin-set 122 faces away from the second pin-set 142, and the second pins 122*b* faces the second pin-set 142, wherein each of the second pins 122*b* has a convex contour, while each of the third pins 142*a* has a concave contour. Therefore, by means of the structural feature of complementary contours, the second pins 122*b* properly correspond to the third pins 142*a*. However, the embodiment does not impose limitation on the contour configuration of each of the pins, which means a contour configuration that enables proper connection of the second pins with the third pins is applicable to the embodiment.

Figure 3:
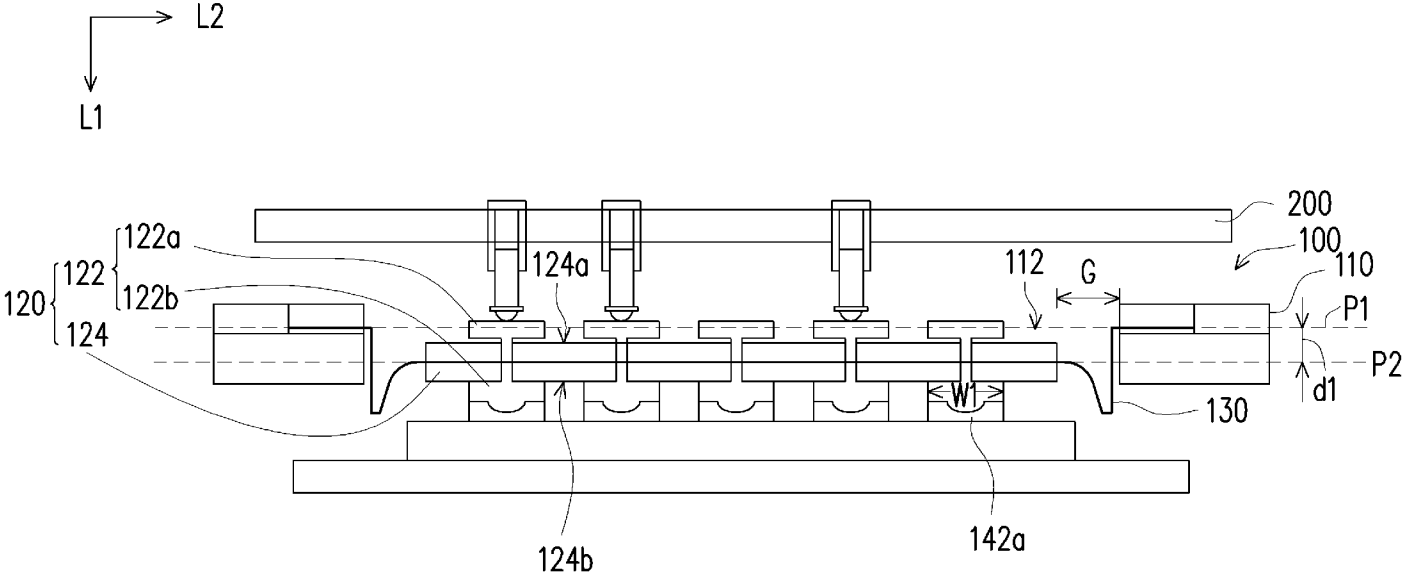
FIG. 3 is a schematic diagram of the connector structure in FIG. 1 in another state.

FIG. 3 is a schematic diagram of the connector structure in FIG. 1 in another state. Referring to both FIGS. 1 and 3, in the embodiment, FIG. 1 illustrates the state of the first electronic assembly in a first position, while FIG. 3 illustrates the state when the first electronic assembly is connected with an external connector and located at a second position. The switching process of the connector structure 100 between the two states are described below.

In the embodiment, the external connector 200 is, for example, a Pogo Pin, but the invention is not limited thereto. As shown in FIG. 1, when the external connector 200 has not been connected with the connector structure 100, the first electronic assembly 120 is maintained at a first position P1 in a floating state via the flexible connecting piece 130. Meanwhile, the second electronic assembly 140 is located beneath the first electronic assembly 120. The second pin-set 142 is away from the first pin-set 122 and keeps a distance d1.

Next, referring to FIG. 3, when the external connector 200 is electrically connected with the first pins 122*a*, the first substrate 124 of the first electronic assembly 120 is pressed to move downward from the first position P1 to a second position P2 along a first axial direction L1 while deforming the flexible connecting piece 130. Now the second pins 122*b* move downward for a distance d1 to be electrically connected with the third pins 142*a*. In addition, the embodiment defines in FIG. 3 that a second axial direction L2 is perpendicular to the first axial direction L1. As shown in FIG. 3, each of the second pins 122*b* has respectively a width W1 in the second axial direction L2. So that the second pins 122*b* and the third pins 142*a* are correspondingly connected properly, the deformable range of the flexible connecting piece 130 along the second axial direction L2 is smaller or equal to half the width W1 of each of the second pins 122*b* in the embodiment. Thereby, the second pins 122*b* are able to be limited by the deformation range of the flexible connecting piece 130 and be connected with the third pins 142*b* more accurately.

Next, when the external connector 200 no longer presses and is moved away from the first electronic assembly 120, the flexible connecting piece 130 drives the first electronic assembly 120 away from the second electronic assembly 140 via resilience, so that the first substrate 124 is repositioned to the state as shown in FIG. 1. That is, the first electronic assembly 120 is able to reposition to the state not pressed by the external connector 200 via resilience of the flexible connecting piece 130, i.e. repositioning from the second position P2 to the first position P1, so that in the connector structure 100 that is not in use, the first electronic assembly 120 and the second electronic assembly 140 resume the state of broken electrical circuit.

Figure 4:
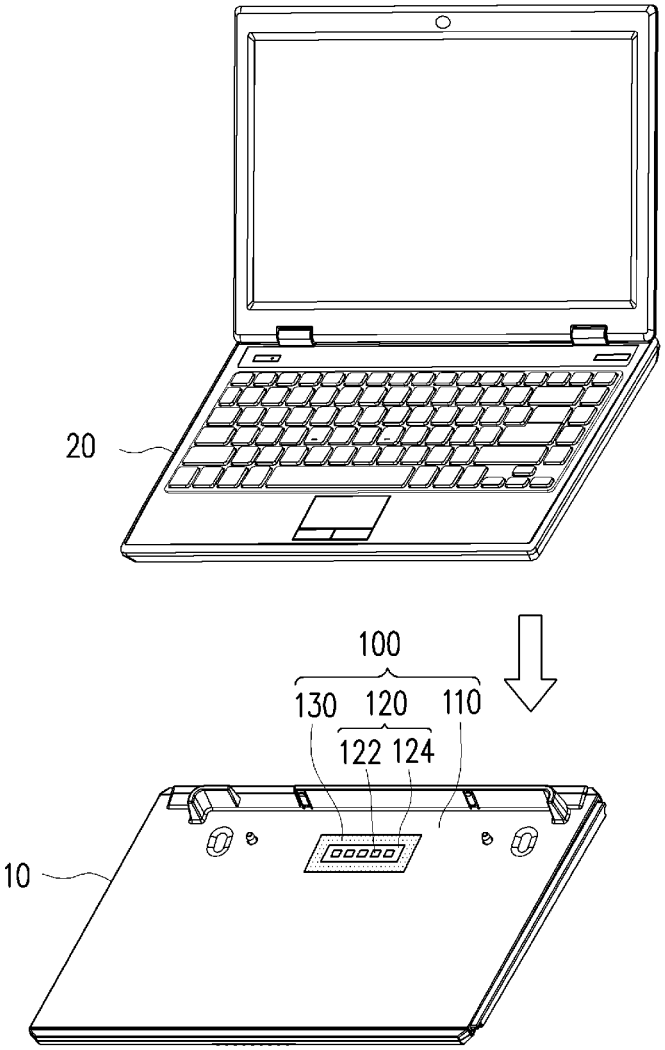
FIG. 4 is a schematic diagram of a connector structure applied to an electronic device according to an embodiment of the invention.

FIG. 4 is a schematic diagram of a connector structure applied to an electronic device according to an embodiment of the invention. In the embodiment, an electronic device 20 takes a notebook computer as an example, and a base 10 is deemed an expanded means (docking base) of the notebook computer, but the invention is not limited thereto.

The connecting structure 100 of the embodiment is disposed on the base 10, and the electronic device 20 is detachably mounted onto the base 10, such that the base 10 is electrically connected to the electronic device 20 via the connector structure 100 to achieve the effect that the electronic device 20 performs data transmission or function expansion with the base 10 via the connector structure 100.

Based on the above, in the invention, since the first electronic assembly is connected to the chassis via the flexible connecting piece and keeps a distance from the second pin-set of the second electronic assembly, the first electronic assembly and the second electronic assembly remain in the state of broken circuit before the external connector is connected to the first electronic assembly. Furthermore, when the external connector is connected with and presses the first pin-set of the first electronic assembly, not only the flexible connecting piece is forced and deformed, but the first pin-set is also able to move downward to be electrically connected to the second pin-set of the second electronic assembly, so as to realize the state of electrical conductance. Accordingly, the connector structure provides the first electronic assembly as the floating switch between the external connector and the second electronic assembly via the flexible connecting piece, so as to achieve the function of electrical connection or broken circuit. Thus, when not in use, the connector structure is exposed from the chassis with the non-electrified first electronic assembly, so that the condition of short circuit or electrolysis does not happen even if exposed to a damp environment.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A connector structure, adapted for connecting with an external connector, the connector structure comprising:

a chassis, having an opening;

a first electronic assembly, comprising:

a first substrate; and a first pin-set, comprising:

a plurality of first pins and a plurality of second pins, disposed respectively on two opposite surfaces of the first substrate;

a flexible connecting piece, located on the surrounding of the first pin-set, wherein the first electronic assembly is connected with the chassis by the flexible connecting piece, so that the first pin-set is exposed from the opening; and a second electronic assembly, located inside the chassis and comprising:

a second substrate, disposed within the chassis and located below the first substrate;

a second pin-set, disposed on the second substrate, located below the first pin-set, keeping a distance from the first pin-set, and comprising:

a plurality of third pins, disposed on the second substrate and facing the second pins, wherein the second pins and the third pins correspond to each other, and the external connector is adapted for electrical connection with the first pins to drive the first substrate to move toward the second substrate along a first axial direction, so that the second pins are electrically connected with the third pins correspondingly, wherein the flexible connecting piece surrounds the first substrate and is connected with the chassis, so that the first substrate floats at the opening;

wherein the first pins face away from the second pin-set, the second pins face the second pin-set, and the first pins and the second pins penetrate the first substrate for being electrically connected correspondingly;

wherein the external connector is adapted for being electrically connected with the first pin-set for deforming the flexible connecting piece, such that the first pin-set moves downward for the distance and is electrically connected with the second pin-set; and wherein a size of the opening is greater than a size of the first substrate, a deformable range of the flexible connecting piece along a second axial direction is smaller than or equal to half a size of each of the second pins along the second axial direction, and the first axial direction is perpendicular to the second axial direction.

2. The connector structure as claimed in claim 1, wherein the flexible connecting piece is elastic, such that the flexible connecting piece is forced and deformed when the external connector is connected to and presses the first pin-set, and the flexible connecting piece drives the first pin-set to reposition to a position before being connected and pressed by resilience of the flexible connecting piece when the external connector is moved away from the first pin-set.

3. The connector structure as claimed in claim 1, wherein each of the second pins has one of convex and concave contours, each of the third pins has the other of the convex and concave contours, and the contours of each of the second pins and each of the third pins are complementary to each other.

4. The connector structure as claimed in claim 1, wherein the flexible connecting piece is rubber sealing a gap between the opening and the first substrate.

5. The connector structure as claimed in claim 1, wherein the external connector is a Pogo Pin.

* * * * *